United States Patent [19]

Andersson et al.

[11] 4,322,591

[45] Mar. 30, 1982

[54] CIRCUIT BREAKER WITH MEANS FOR PRODUCING A FLOW OF ARC-EXTINGUISHING GAS

[75] Inventors: Erik Andersson; Carl E. Solver, both of Ludvika, Sweden

[73] Assignee: ASEA Aktiebolag, Vesteras, Sweden

[21] Appl. No.: 148,832

[22] Filed: May 12, 1980

[30] Foreign Application Priority Data

May 18, 1979 [SE] Sweden ..... 7904368

[51] Int. Cl.[3] ..... H01H 33/88

[52] U.S. Cl. ..... 200/148 A

[58] Field of Search ..... 200/148 A

[56] References Cited

U.S. PATENT DOCUMENTS

| | | | |
|---|---|---|---|
| 2,922,010 | 1/1960 | Cromer et al. | 200/148 A |
| 3,331,935 | 7/1967 | Milianowicz | 200/148 A |
| 3,786,215 | 1/1974 | Mauthe | 200/148 A |

FOREIGN PATENT DOCUMENTS

| | | | |
|---|---|---|---|
| 4731192 | 12/1967 | Japan | 200/148 A |

*Primary Examiner*—Robert S. Macon

*Attorney, Agent, or Firm*—Watson, Cole, Grindle & Watson

[57] ABSTRACT

A puffer type circuit breaker is provided with a pump means consisting of a piston and a cylinder for producing a blast of arc-extinguishing gas. The piston is axially displaceable against a spring force, and the cylinder is joined to the movable contact of the circuit breaker and arranged, during a breaking operation, to compress the gas in the cylinder space of the pump means to achieve a blast of extinguishing gas towards the contact area. A spring holds the piston pressed against a stop in the closed as well as the open position of the circuit breaker. The spring has such a high pre-stress that the piston only moves upon breaking of short-circuit currents.

4 Claims, 4 Drawing Figures

CIRCUIT BREAKER WITH MEANS FOR PRODUCING A FLOW OF ARC-EXTINGUISHING GAS

BACKGROUND

1. Field of the Invention

The present invention relates to puffer type circuit breakers, and in particular to such circuit breakers having a gaseous arc-extinguishing medium and which generate a blast of arc-extinguishing gas towards the contact area of the circuit breaker.

2. Prior Art

In circuit breakers of the so-called puffer-type, the gas blast energy is generated by compression of gas in a cylinder during the breaking operation. In order for such a breaker to manage a given interruption involving a certain current at a certain recovery voltage, the contact distance and the blast pressure have to exceed certain minimum values at one of the zero passages of the current. Since the phase position of the current may vary arbitrarily, such conditions have to be fulfilled for a sufficient length of time, for example 15 ms, so that a zero current passage occurs with certainty during that interval.

In conventional puffer-type circuit breakers, the pump piston is fixedly mounted and the cylinder is joined to the movable contact and moves together therewith. Such a design places heavy demands on the operating device of the circuit breaker, which operating device must have an accurately adapted motion and force characteristic in view of the above-mentioned demand on the blast pressure. It is particularly difficult to maintain the blast pressure above a certain minimum level for a sufficient time when a short breaking time is desired, for example for a two-cycle breaker, as the breaker must then be constructed with extra high contact speed, which, in an embodiment with a fixed pump piston, means that the pump motion is terminated within a relatively short time.

The puffer-type circuit breakers with a resilient piston which have been proposed previously also suffer from the above-mentioned drawbacks. In some such known designs, the spring of the piston of the pump means is compressed at the end of the opening operation of the circuit breaker through mechanical action from the operating device of the breaker, for example as described in German Offenlegungsschrift No. 1,765,153 and Swedish Pat. No. 369,352. In these designs the piston has no pressure-equalizing function but is arranged for the purpose of achieving a greater insulating distance between the contacts when the breaker is open, and a slowing-down of the movable contact and the puffer cylinder connected thereto.

According to other known proposals, a spring-loaded auxiliary piston is arranged in addition to the main piston for the purpose of achieving a quicker pressure increase in the puffer cylinder during the starting stage of the breaking operation. In a proposed design of this kind as described in British Pat. No. 1,438,590, the movable puffer cylinder comprises two coaxial cylinder spaces with different diameters, of which the cylinder space with the smaller diameter accommodates the fixed main piston, whereas the cylinder space with the larger diameter accommodates the auxiliary piston. The gas in the cylinder space of the auxiliary piston is pressed over into the main cylinder space during the starting stage of the breaking operation. During the critical final stage of the breaking operation, however, the auxiliary piston is inactive.

In another known design as described in British Pat. No. 1,438,708, the spring-loaded auxiliary piston is arranged in the puffer cylinder between the main piston and the contact area. The spring that affects the piston is dimensioned such that it is compressed at an early stage of the opening operation of the breaker. The auxiliary piston has a through opening provided with a non-return valve, enabling gas to flow in a direction from the space between the main piston and the auxiliary piston to the contact area. Because of the flow resistance at the opening, however, a rapid supply of extinguishing gas from that space is prevented when the pressure at the contact area is reduced during the interval which is critical for the breaking operation at the zero passage of the current.

SUMMARY OF THE INVENTION

The purpose of the present invention is to provide a high-speed puffer circuit breaker with a high breaking capacity which utilizes a relatively simple operating device. This is achieved by a spring force holding the piston against a stop in both the closed and open positions of the circuit breaker. The spacing has a sufficiently high pre-stress that it only moves when the gas pressure in the cylinder space exceeds the pressure generated upon interruption of the rated operating current of the circuit breaker. A circuit breaker constructed with a resilient piston in this manner, is capable of maintaining the blast pressure above a certain minimum level for a relatively long time because of the pressure-equalizing action of the piston. This also applies when the contact speed of the circuit breaker is relatively high, since the resilient piston may operate also after the opening movement of the circuit breaker is terminated. Therefore, the design is particularly suitable for circuit breakers in which a short breaking time is desirable, for example so-called two-cycle circuit breakers. Because the resilient piston has the ability to maintain the blast pressure by its pressure-equalizing action, the operating device may have a relatively simple design.

BRIEF DESCRIPTION OF THE DRAWINGS

The invention will be described in greater detail with reference to an embodiment shown in the accompanying drawing, in which.

DETAILED DESCRIPTION

Figure 1:
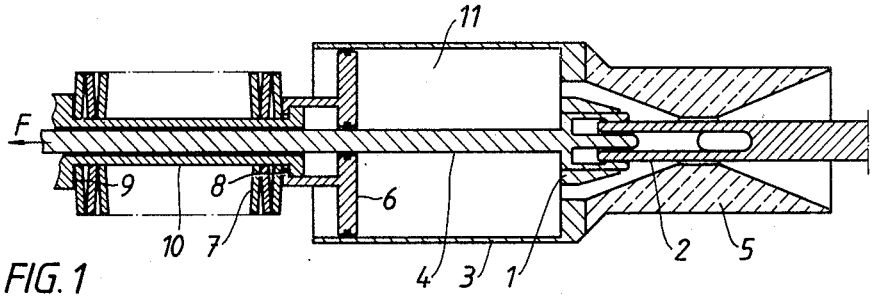
FIG. 1 shows a puffer-type circuit breaker according to the invention in the closed position.
Figure 2:
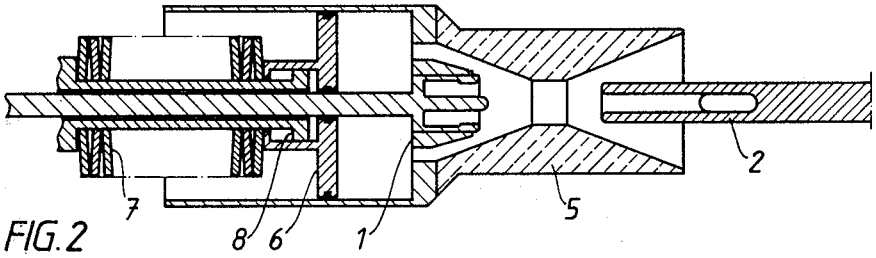
FIG. 2 shows the circuit breaker in an intermediate position during an opening operation with a considerable amount of current in the breaker.
Figure 3:
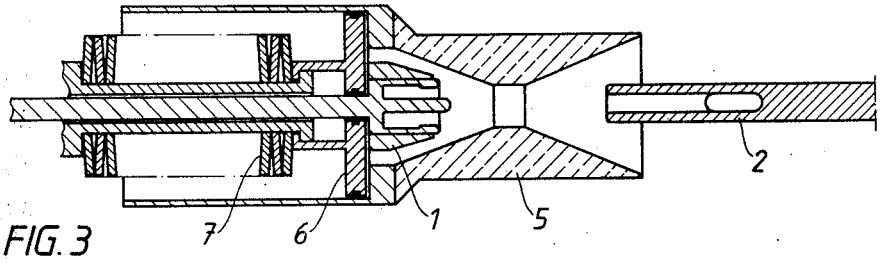
FIG. 3 shows the circuit breaker in the open position.

The circuit breaker shown in FIGS. 1 to 3 is accommodated within an elongated extinguishing chamber (not shown) which is preferably completely closed and filled with electronegative gas, for example sulphurhexafluoride, at an over-pressure of a few atmospheres. The contact device comprises sleeve contact 1 which is axially movable to and from fixed plug contact 2. Movable contact 1 supports puffer cylinder 3 and is connected to an operating device (not shown) via operating rod 4. Blast nozzle 5 of a suitable insulating material, for example polytetrafluoro ethylene, is mounted on movable contact 1 in such a way that the nozzle surrounds the area between contacts 1 and 2 (the contact area) during a breaking operation. Sliding piston 6, sealed against the cylinder wall, is located in puffer cylinder 3, piston 6 being pressed by strong compression spring 7 into making contact with stop 8. Spring 7 rests against support member 9, which is fixedly mounted with respect to the extinguishing chamber. Stop 8 is joined to support member 9 by tube 10, which also acts as a guide for operating rod 4. The external current connection to movable contact 1 is made by means of sliding contacts (not shown) via puffer cylinder 3, which is made of copper or aluminum.

When a breaking operation is to be performed, a force is applied by the operating device of the circuit breaker on operating rod 4 in the direction of arrow F. Contact 1, puffer cylinder 3 and blast nozzle 5 thus move to the left, the gas in cylinder space 11 thus being compressed. When contacts 1 and 2 are separated, an arc is created, which causes an additional pressure increase in the cylinder space. At a predetermined pressure the spring force of spring 7 is overcome, piston 6 then being displaced to the left. Thereafter the volume of cylinder space 11 is increased during the interval when the instantaneous valve of the current is high, the pressure increase in cylinder space 11 thus being limited and an equalization of the pressure in the cylinder space being achieved over a longer time interval. By limiting the maximum pressure, a slowing-down of the movable contact—which is unfavorable to arc extinction—is also prevented. In the vicinity of zero current, when the pressure generated by the arc is reduced, spring 7 returns piston 6 to stop 8, the volume of cylinder space 11 is reduced and the pressure maintained. In this way the blast of extinguishing gas is maintained through nozzle 5, the dielectric strength in the contact area thus being rapidly built up so that restriking of the arc is prevented.

Spring 7 has a very high pre-stress, so that piston 6 moves only in extreme cases, i.e. upon breaking of short-circuit currents. When breaking lower currents, the pressure in the compression volume does not reach such a level that the spring is compressed.

Figure 4:
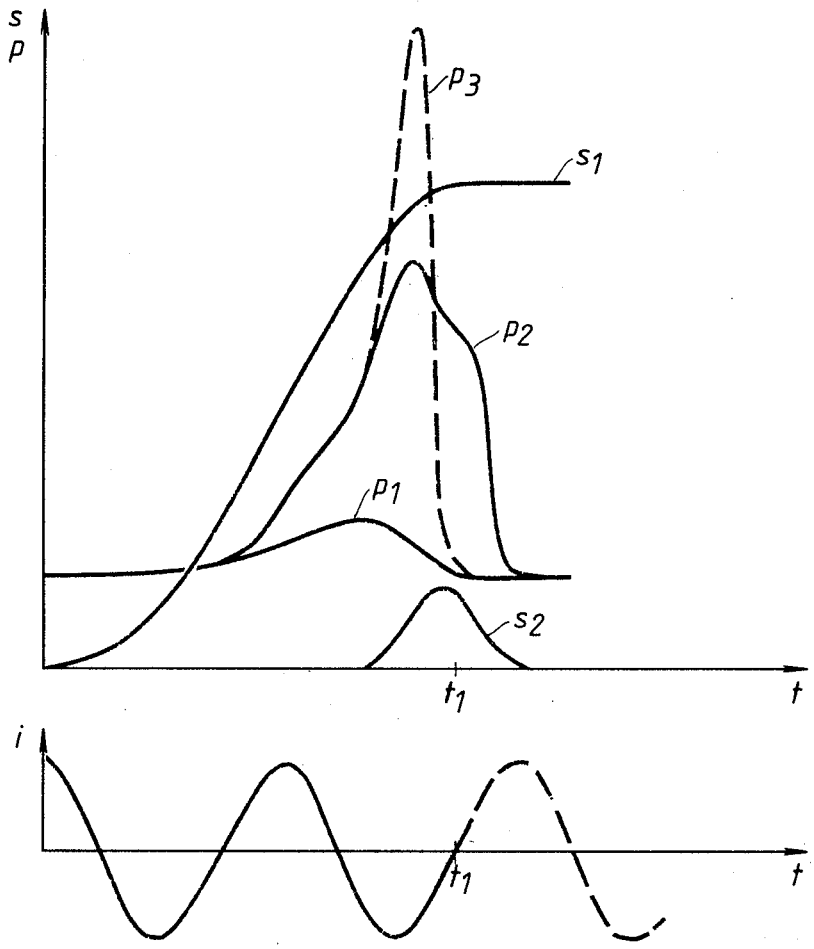
FIG. 4 shows examples of motion and pressure characteristics for puffer-type circuit breakers with a movable piston and without a movable piston, respectively.

FIG. 4 shows examples of movement and pressure curves for a puffer-type circuit breaker according to the invention and for a conventional circuit breaker with a fixed piston, wherein s designates the movement distance, p the pressure, i the current and t the time. The different curves show the following:

$s_1$=contact motion
$s_2$=piston motion (with current)
$p_1$=no load pressure
$p_2$=pressure with movable piston (with current)
$p_3$=pressure without movable piston (with current)

In addition, the current i through the circuit breaker is drawn into the same position in time as the other curves.

$t_1$ designates the time (current zero passage) when the current is interrupted in the circuit breaker according to the invention. The conventional circuit breaker with a fixed piston has a considerably lower blast pressure at this time and would probably fail if a corresponding interruption attempt was made.

When drawing the curves in FIG. 4, for the sake of simplicity the contact motion $s_1$ has been assumed to be the same in all three cases, i.e. at no load and at short-circuit current with and without a movable piston, respectively. In reality the movement is slowed down somewhat towards the end when current is present in the circuit breaker.

It is clear from the curves that, among other things, a circuit breaker with a movable piston according to the invention provides blast pressure for a considerably longer time than a circuit breaker with a fixed piston.

Contrary to prior art puffer-type circuit breakers with a movable, spring-loaded piston, in the circuit breaker according to the invention the piston has the same position when the breaker is in open position as when the breaker is in the closed position, i.e. the spring is not "mechanically" compressed at the end of an opening operation. This results in the considerable advantage that the piston operates and also maintains the blast pressure after the contact movement has been completed, as is clear from FIG. 4.

What is claimed is:

1. Electric circuit breaker having a gaseous arc-extinguishing medium comprising:
- a fixed and a movable contact;
- a pump means including a relatively stationary piston and a movable cylinder;
- a spring for biasing said piston axially;
- said cylinder being joined to said movable contact and, during a breaking operation, compressing the gas in the cylinder space of said pump means to create a blast of extinguishing gas towards the contact areas of the circuit breaker;
- a stationary mounted stop member;
- said spring retains said piston pressed against said stop member in the closed as well as the open position of the circuit breaker; and
- said spring having such a high pre-stress that said piston only moves when the gas pressure in the cylinder space exceeds a value which is higher than the pressure generated upon an interruption of the rated operating current of the circuit breaker.

2. Circuit breaker according to claim 1, wherein said piston only moves upon interruption of a short-circuit current.

3. Circuit breaker according to either claim 1 or 2, further comprising a blast nozzle for guiding the blast of extinguishing gas and supported by said movable contact.

4. Circuit breaker according to claim 1, 2 or 3, further comprising a chamber filled with electro-negative gas and enclosing said fixed and movable contacts, cylinder, piston and spring.

* * * * *